US005916079A

United States Patent [19]

Haring et al.

[11] Patent Number: 5,916,079

[45] Date of Patent: Jun. 29, 1999

[54] HORIZONTAL CONTAINER FORMING MACHINE

[75] Inventors: David S. Haring; Michael A. White, both of Kennewick, Wash.

[73] Assignee: Delaware Capital Formation, Wilmington, Del.

[21] Appl. No.: 08/909,006

[22] Filed: Aug. 8, 1997

[51] Int. Cl.[6] ..... B31B 1/12; B31B 1/62

[52] U.S. Cl. ..... 493/125; 493/131; 493/168; 493/179; 493/909

[58] Field of Search ..... 493/125, 123, 493/122, 130, 131, 179, 178

[56] References Cited

U.S. PATENT DOCUMENTS

| | | | |
|---|---|---|---|
| 3,635,129 | 1/1972 | Cobelo, Jr. | 493/131 |
| 4,164,171 | 8/1979 | Meyers et al. | 493/131 |
| 4,498,893 | 2/1985 | Odom | 493/125 |
| 4,926,615 | 5/1990 | Alexander | 53/207 |
| 5,211,529 | 5/1993 | Esala et al. . | |

OTHER PUBLICATIONS

R.A. Pearson Company brochure –Trayformers.
Hullpak Manufacturing Inc. brochure –H4610 Tray Former.
SWF / Hullpak Mfg. Inc. flyer –H4500 Automatic Tray Former.

*Primary Examiner*—John Sipos
*Assistant Examiner*—Steven Jensen
*Attorney, Agent, or Firm*—Mark D. Miller

[57] ABSTRACT

An improved horizontally-oriented machine capable of forming a trays or other similar fiberboard containers from single blanks. The improved machine includes three distinct sections: (1) a loading bay which includes a vertical lift, a sheet feeders and a unique set of gates for pre-positioning the end flaps of container blanks for later folding; (2) an adhesion and flap-folding section which includes adhesive applicators, a series of folding plows and a compression area for pre-folding the end flaps of the container to be formed; and (3) a final forming section including an adjustable vertically mounted mandrel surrounded by adjustable forming plows for making the final container. The flap-folding section includes a flight chain assembly which can be easily lowered when the machine is not operating, to allow service access to the interior of the machine in the event of a jam or misfeed, thereby avoiding the time consuming task of cutting or tearing out the misfeed, and allowing the machine to be quickly brought back on line.

15 Claims, 11 Drawing Sheets

HORIZONTAL CONTAINER FORMING MACHINE

BACKGROUND OF THE INVENTION

1. Field of the Invention

The present invention relates to container forming machines, and in particular to a new and improved horizontally oriented method and apparatus for forming containers from a pre-cut fiberboard material blank.

2. Description of the Prior Art

In the packaging industry, numerous fiberboard containers and designs have been developed over the years. Such containers are typically constructed of a corrugated material and are used to ship and store a wide variety of products such as fresh fruits and vegetables, canned and bottled goods, meat, and the like. The fiberboard materials may be single face corrugated, single wall (double-faced) corrugated, double wall corrugated, triple wall corrugated, etc. Containers may also be made of other paperboard products including, without limitation, container board, boxboard, linerboard, and cardboard.

In the industry, the terms "case" and "box" are often used interchangeably. These terms each refer to a large, usually rectangular containers made out of fiberboard or paperboard and designed to hold a given number (e.g. 12 or 24) of smaller units such as cartons, bottles, cans, or produce pieces. The term "tray" is used to describe a variety of different containers, but often refers to a container designed to holding a certain weight or volume of product (e.g. 35 pounds of grapes, 60 pounds of beef, etc.).

Existing tray forming machines suffer from many drawbacks. The box forming parts of these machines take in flat paperboard container blanks from the bottom and process them in a vertical fashion. They are capable of receiving a large stack of flat paperboard container blanks, but must first go through the wasteful step of removing the blanks one by one from the top of the stack and re-stacking the blanks in a second stack for removal from the bottom. In addition, if a container blank should be improperly fed into or jam inside such a machine, it is extremely difficult to gain access to the inside of the machine to remove the clogged blank. Often it becomes necessary to cut or tear out the blank in pieces or to partially disassemble the machine in order to remove it.

Many existing machines depend solely upon an extendible and retractable mandrel working in conjunction with angled plows to form the entire container in a single stroke. It can be difficult or impossible for these machines to form paperboard containers with accomplish with multiple walls and/or multiple folds of the same panel. In addition, most current machines are also either incapable of producing very large tray containers, or are unable to produce such large containers in acceptable production volumes. Finally, current machines themselves are unusually large and tall, requiring an unnecessarily large space for the installed machine.

SUMMARY OF THE INVENTION

The present invention overcomes the aforementioned drawbacks of existing container forming machines by providing an improved horizontally oriented machine capable of forming trays or other similar fiberboard containers from a single blank. The improved machine includes three distinct sections: (1) a loading bay which includes a vertical lift, a sheet feeder, and a unique set of gates for pre-positioning the flaps of container blanks; (2) an adhesion and flap-folding section which includes adhesive applicators, a series of folding plows and a compression area for pre-folding the end flaps of the container to be formed; and (3) a final forming section including an adjustable vertically mounted mandrel surrounded by forming plows for making the final container.

The loading bay is capable of receiving a complete pallet of pre-cut container blanks. Once loaded, a vertical lift in the bay raises the stack of blanks upward until they reach the working height of the machine. Squaring arms in the walls of the bay are capable of moving slightly in and out in order to center the stack of blanks in the bay. Then, a series of suction cups removes the top blank from the stack and holds it in position. At this point, a set of four unique gates located on the sides of the loading bay are activated. These gates work in conjunction with the suction cups to break the leading and trailing edges of the container blank along pre-cut lines, separating these outer flaps from the mid section of the blank in anticipation of further folding. The overhead chain drive sheet feeder then conveys the blank into the adhesion and flap-folding section of the machine.

As the blank is moved into the next section of the machine, adhesive material is sprayed or placed onto selected locations of the blank. A flighted chain assembly (with lugs) then drives the blank horizontally through a series of folding plows and a compression area. Here the front and back walls of the container are pre-formed from the outer flaps of the blank. The pre-formed blank is then moved into the forming mandrel section of the machine.

The flap-folding section of the machine may be easily accessed from the outside in the event that a container blank becomes entangled or jammed in this section of the machine. Easily opened side doors are provided for service access. If necessary, the flighted chain assembly may be quickly and easily lowered in order to facilitate full access for service and easy removal of entangled, jammed or improperly folded container blanks. This obviates the need to cut out the paperboard pieces and/or disassemble the machine in order to remove a jam, allowing the machine to be quickly brought back into production.

The pre-folded blank is moved from the flap-forming section to the final forming section of the machine, below a vertically oriented mandrel. The mandrel pushes down on the middle of the blank, forcing the edges through a set of forming plows. First, the pre-formed leading and trailing edges of the blank are forced upright to form the end walls and corners of the container. Then, as the mandrel moves down, the side walls of the blank are forced upright into adhesive contact with the end wall corners, forming the final container with its top flaps open. The mandrel retracts, and then the plows release the container, allowing it to drop using gravity to fall onto a conveyor for removal.

It is therefore a primary object of the present invention to provide a horizontally oriented machine capable of forming fiberboard containers without the unwieldy height dimensions of conventional machines.

It is a further important object of the present invention to provide a horizontally oriented container forming machine that is capable of forming very large containers in continuous operation.

It is a further important object of the present invention to provide a horizontally oriented container forming machine that is capable of high volume production of large containers at good speed.

It is also an important object of the present invention to provide a horizontally oriented container forming machine having a first section for loading, separating and pre-folding container blanks, a second section for flap folding and adhesion of the container blanks, and a third section for final formation of containers from the blanks.

It is another important object of the present invention to provide a unique set of gates and suction cups in the loading section of the machine which work in conjunction with each other to break the leading and trailing edges of the container blank along pre-cut lines, separating these outer flaps from the mid section of the blank in anticipation of further folding.

It is another important object of the present invention to provide a unique set of plows and guides in the flap folding section of the machine which form the front and back walls of the container from the blank.

It is another important object of the present invention to provide an adjustable flighted chain assembly in the flap folding section of the machine which is raised during production and may be easily lowered for service access.

It is another important object of the present invention to provide a container forming machine which is capable of receiving a full pallet stacked with pre-cut container blanks and removing blanks from the top of the stack for formation into containers.

Additional objects of the invention will be apparent from the detailed descriptions and the claims herein.

DETAILED DESCRIPTION OF THE DRAWINGS

Figure 1:
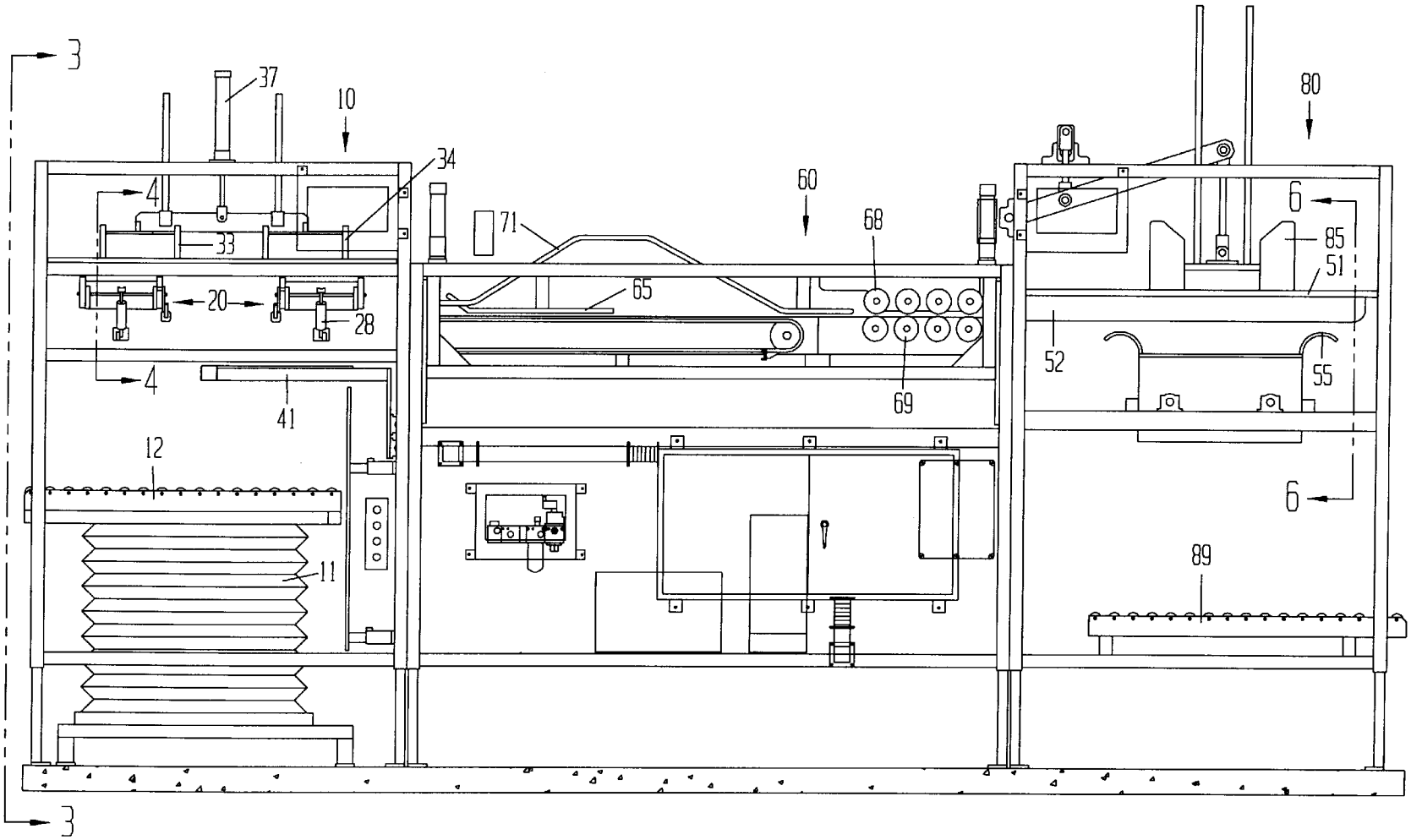
FIG. 1 is a partially cut away side view showing the three major sections of the machine of the present invention.
Figure 2:
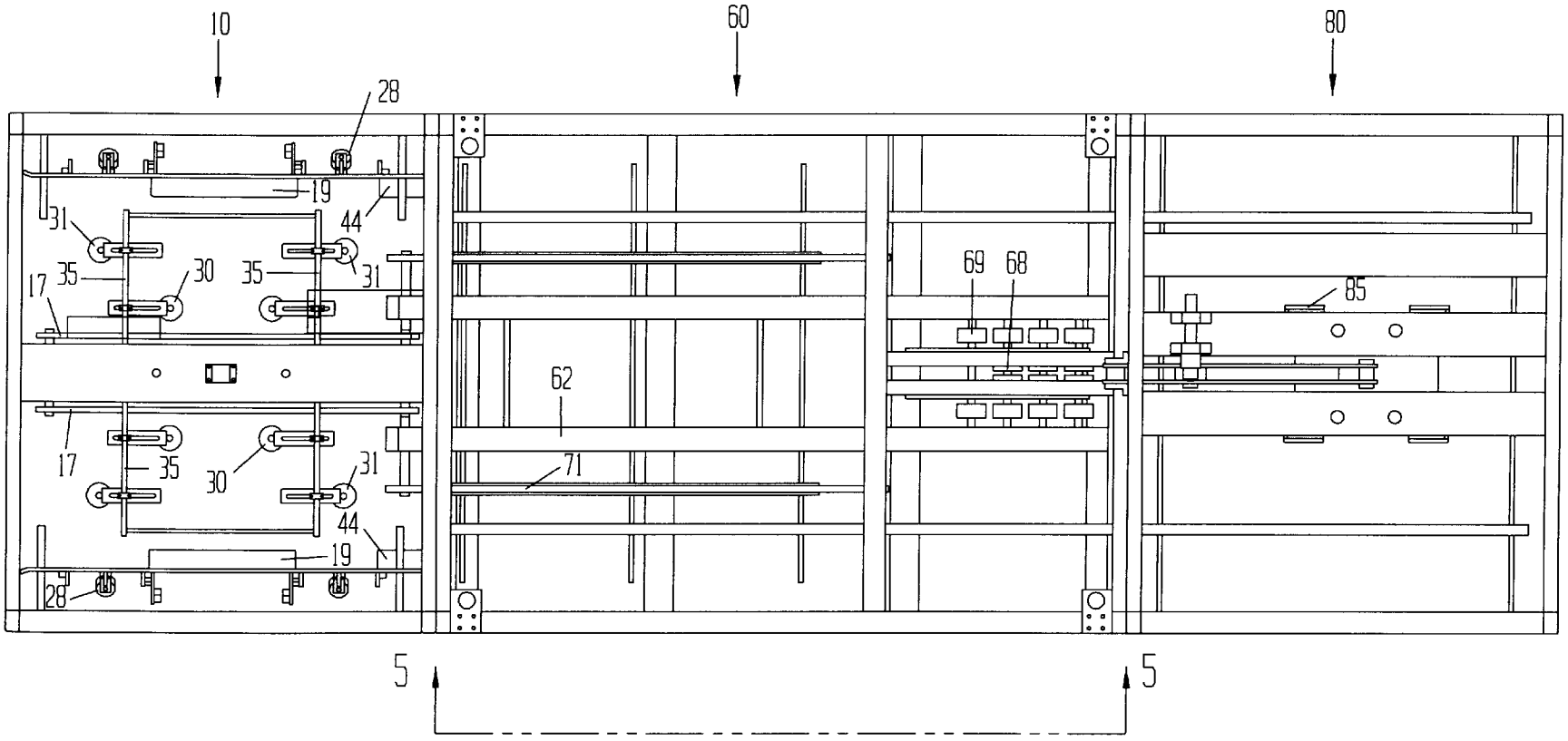
FIG. 2 is a partially cut-away top view of the invention shown in FIG. 1.

Referring to the drawings wherein like reference characters designate like or corresponding parts throughout the several views, and referring generally to FIG. 1 it is seen that the operative portion of the invention includes three distinct sections including a loading bay 10, an adhesion and flap-folding section 60 and a forming section 80.

Loading bay 10 includes a vertical lift 11 with platform 12 for holding a single stack of pre-cut container blanks 14 up to forty eight inches (48") in height. Adjustable squaring arms 41 are provided on either side of the loading bay. Crank 42 is used to adjust the position of arms 41 according to the size of the container blanks used. A set of interior suction cups 30 and exterior suction cups 31 are centrally provided above loading bay 10 (see FIG. 2 and FIGS. 3A–3C). Interior cups 30 are positioned to engage the middle of the top container blank 91 from the stack, whereas exterior cups 31 are positioned to engage the outer edges 92 of blank 91. All of these suction cups are connected to a common vacuum source 32 (not shown) which selectively provides vacuum suction to the cups 30 and 31 for removal of the top blank 91 from the stack. Interior cups 30 are attached by vertical rods 33 to crossbars 35 such that their upward motion is limited as crossbars 35 are raised. However, exterior cups 31 are attached by different rods 34 to crossbars 35 such that their upper limit of travel is higher than that of interior cups 30 (compare FIGS. 3A and 3B).

Figure 3A:
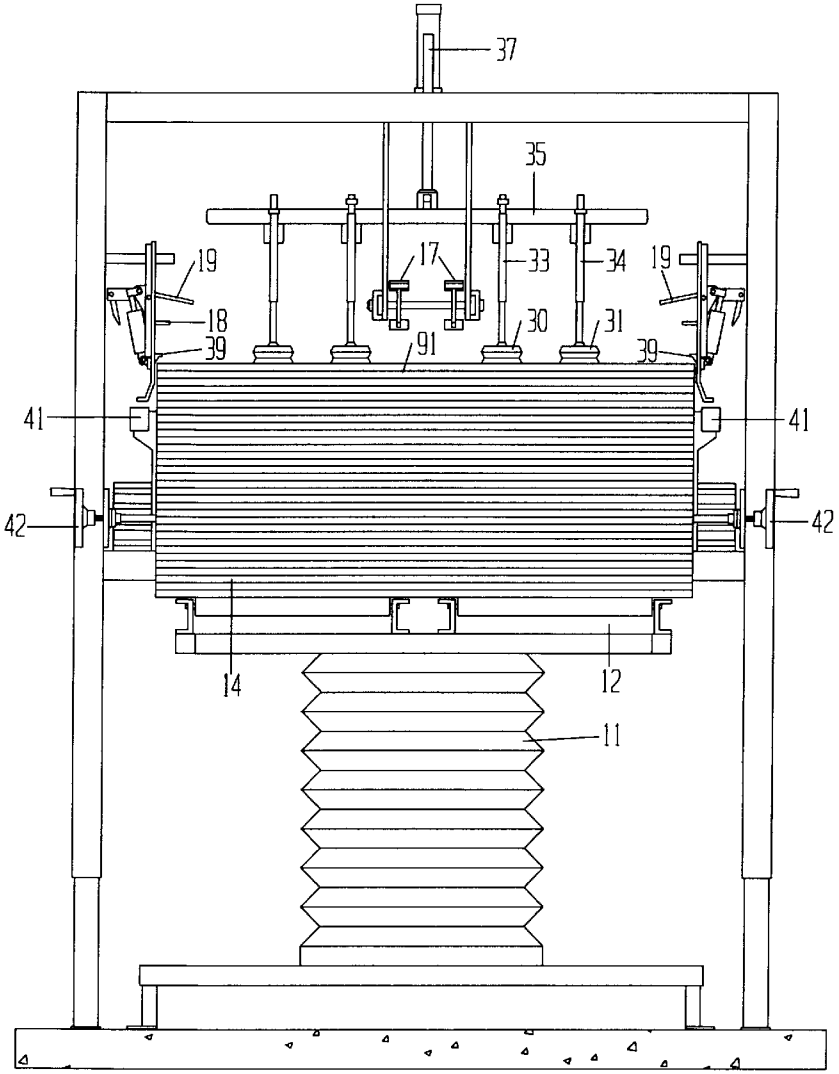
FIG. 3A is an end view along line 3—3 of FIG. 1 showing a stack of container blanks on a pallet which has been raised to the working height of the machine. The suction cups have lowered to engage the top blank, but it has not yet been removed from the stack. The side gates are fully retracted.

In operation, lift 11 raises the stack of container blanks 14 up to the working height set by lips 39 as shown in FIG. 3A. Squaring arms 41 center the blank in position. Once the uppermost blank 91 in the stack 14 is in this position, suction cups 30 and 31 are lowered by air cylinder 37 to make contact with the blank. Vacuum suction is then applied to cups 30 and 31 temporarily adhering them to blank 91. At this point, air cylinder 37 is raised, bringing crossbars 35 and rods 33 and 34 up with it. The interior cups 30 are not raised as high as exterior cups 31 resulting in uneven lifting of blank 91. This uneven lifting raises the outer edges 92 of blank 91 higher than the interior walls 93 (see FIG. 3B and compare FIGS. 7A to 7B).

Figure 7:
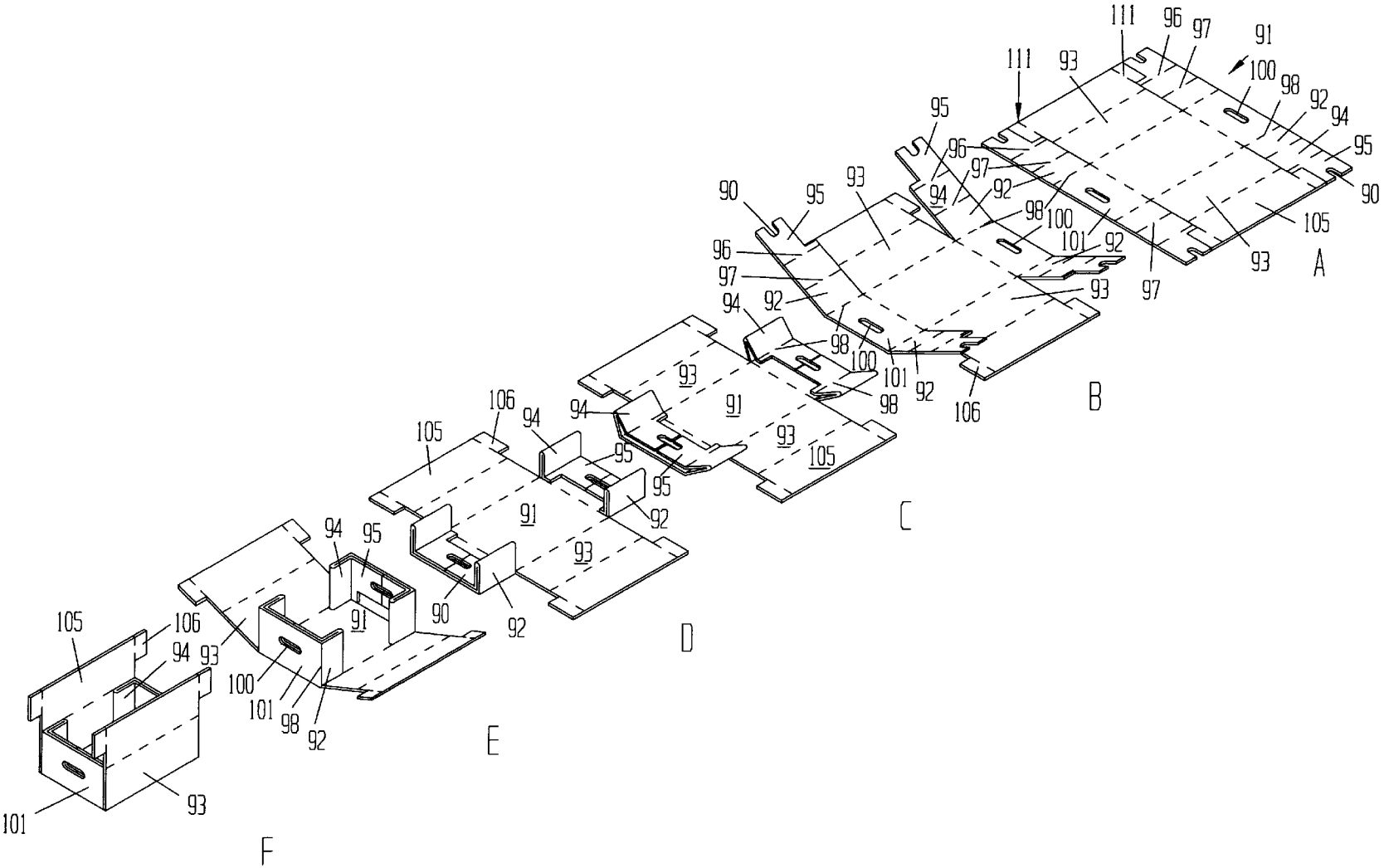
FIG. 7 is a series of perspective views of a laminated corner post tray container blank showing the stages of formation by the machine of the present invention
Figure 8:
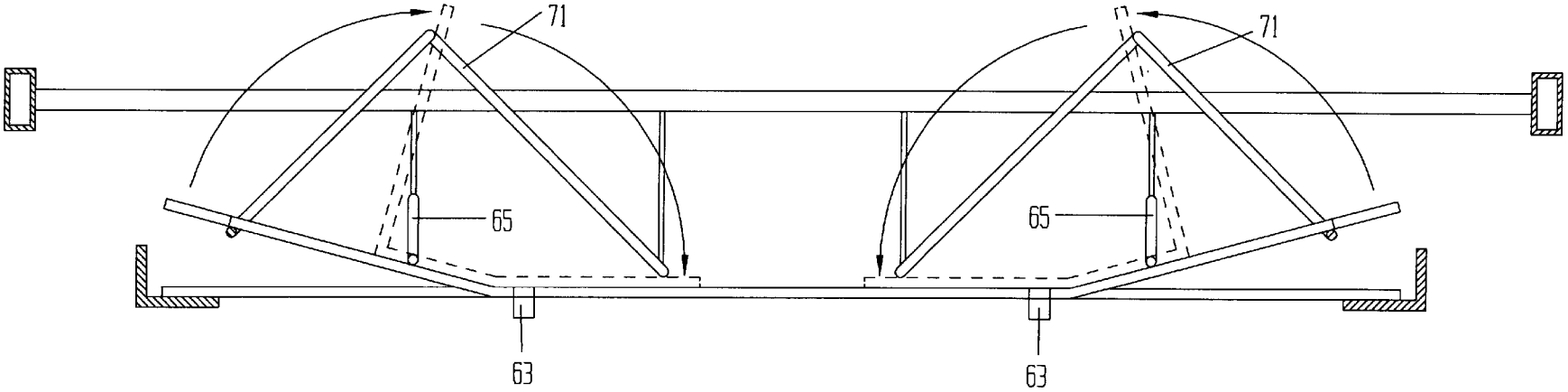
FIG. 8 is an enlarged end view along line 8—8 of FIG. 5A showing how the angled plows fold a blank.

At this stage, blank 91 has been slightly deformed as shown in FIG. 7B with the pre-cut flaps 92 being separated from the side walls 93 of blank 91. It is important to maintain the separation of flaps 92 from walls 93 in order for the blank 91 to be properly folded and eventually formed into a container. In order to maintain the separation shown in FIG. 7B, a set of four gate mechanisms 20 are provided in the side walls of loading bay 10. Gates 20 operate in conjunction with the above-described suction apparatus.

Figure 4A:
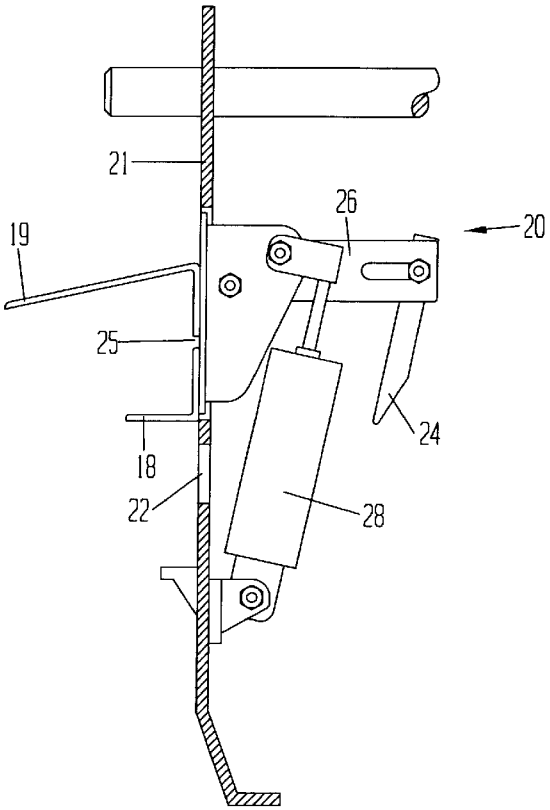
FIG. 4A is an enlarged end view along line 4—4 of FIG. 1 showing the gates in the retracted position.
Figure 3B:
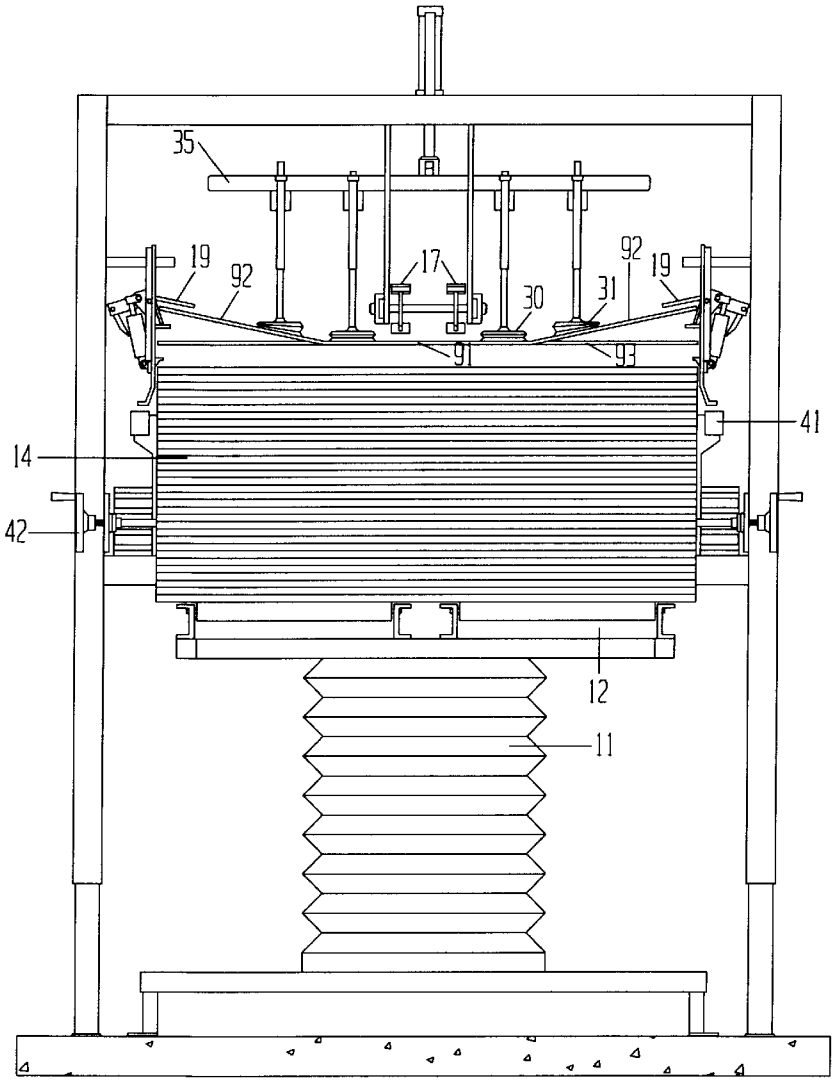
FIG. 3B is an end view along line 3—3 of FIG. 1 showing the removal of the top container blank from the stack using the suction cups. The side gates have begun to advance.
Figure 3C:
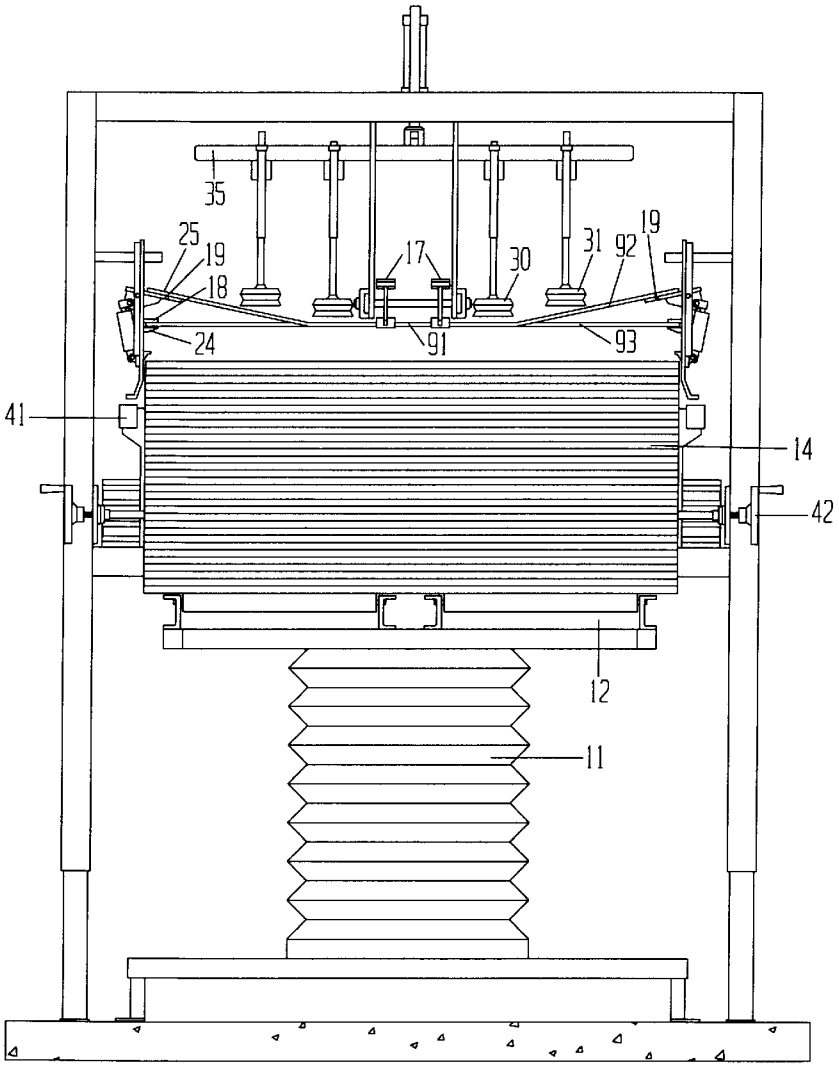
FIG. 3C is an end view along line 3—3 of FIG. 1 showing the side gates fully extended and supporting the top container blank. The suction cups have disengaged the blank and retracted.

Before the uppermost blank 91 is removed from stack 14, gates 20 are closed such that they do not interfere with the suction removal and raising of blank 91 from the top of the stack (see FIG. 3A and detail at FIG. 4A). A set of limiting flanges 18 are provided in the vicinity of the four gates 20 to prevent side walls 93 of blank 91 from being lifted too high. FIG. 3B shows these side walls approaching limiting flange 18, and FIG. 3C shows the walls touching the flanges, having reached the limits defined thereby.

Figure 4B:
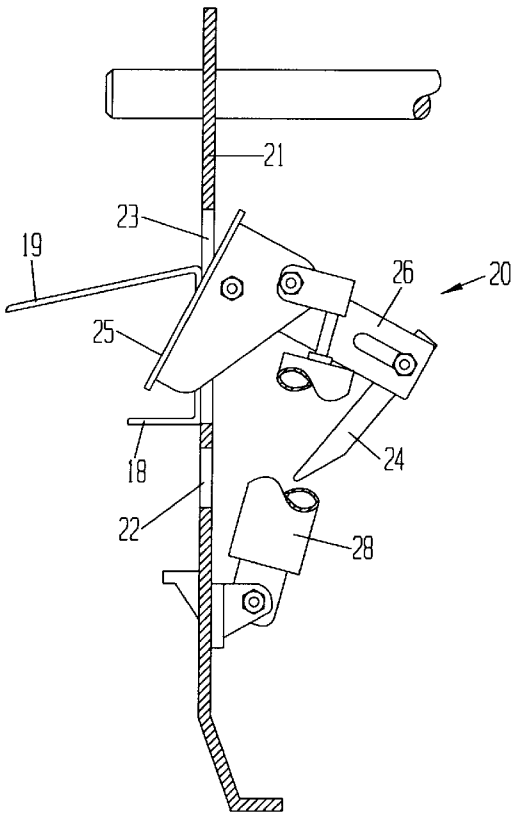
FIG. 4B is an enlarged end view along line 4—4 of FIG. 1 showing the gates partially advanced.

As the suction cups 31 pull outer flaps 92 upward and away from side walls 93, gates 20 are activated and move into position to support flaps 92 (see FIGS. 3B and 4B). Gates 20 are mounted on the outside of the walls 21 defining the sides of the loading bay. Each gate 20 has two different protruding flange projections: an upper support 25 for outer flaps 92, and a lower support 24 for side walls 93. Corresponding openings 22 and 23 are provided in walls 21 to allow the projections to protrude into the loading bay. The projections are both attached to a common pivotally mounted bracket 26 and moved by the action of air cylinder (piston) 28. Support plate 25 is movable between a position that is flush with wall 21 to a position that is flush with an angled rail 19 discussed below.

Figure 4C:
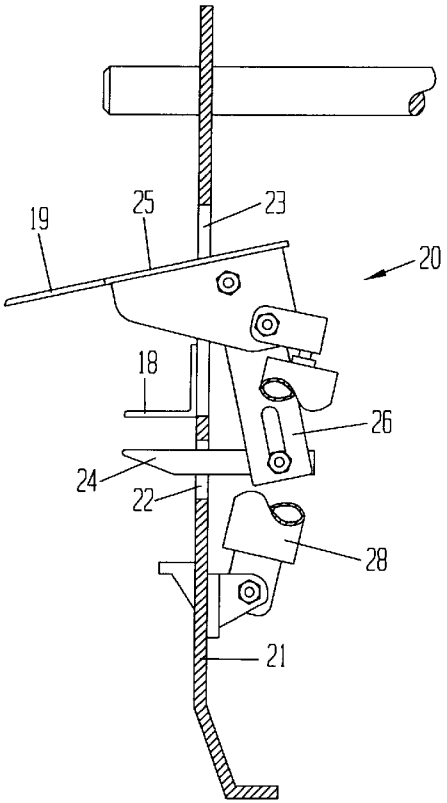
FIG. 4C is an enlarged end view along line 4—4 of FIG. 1 showing the gates in the fully advanced position.

After the outer suction cups 31 have pulled flaps 92 to their maximum height and separation from side walls 93, it is important to maintain this relationship. This is accomplished by the upper protruding flange 25 of gates 20. Gates 20 are activated as the suction pulls flaps 92 upward, extending flanges 24 and 25 into the loading bay. Flanges 25 of gates 20 come in under and provide support to flaps 92, preventing these flaps from moving back down to the lower plane of side walls 93 (see FIG. 3C). The extension of flanges 25 forms a continuous lip with a second set of angled flanges 19 provided on the inside walls of the loading bay between gates 20 (see FIG. 2, 3C and 4C). Another set of similarly angled flanges 44 are also provided between the interior gates and the flap-forming section 60 of the machine. Flanges 19 and 44 act in conjunction with extended gate flanges 25 to hold outer flaps 92 in their upwardly angled position as blank 91 is moved horizontally out of the loading bay into the flap-folding section 60 of the machine.

An overhead feeder 17 operated by chains or other continuous bands is provided for moving removed blank 91 horizontally into the flap-folding section 60 of the machine. As the container blank 91 is moved into this section, adhesive material is applied to selected areas of the blank including panels 92, 93, 94 and 101 in either hot mix spray or cold application.

Referring to FIGS. 1, 2, 5A and 5B, it is seen that a series of flap-folding plows and rods 71 (many of which are not shown) are provided in section 60 of the machine. As the blank 91 is forced against these plows, they fold the end panels 92 on both ends of the blank 91 along pre-scored lines 96, 97 and 98 into the configuration shown first in FIG. 7C and finally to the configuration of FIG. 7D. Brace 65 holds the body panel 91 and side panels 93 horizontal while the end panel corners are formed by plows 71 from the outer edges 92 of the blank.

Blank 91 is pushed through section 60 of the machine first by means of a continuous band conveyor or flighted chain assembly 62 with cleats or lugs 63, and then using upper 68 and lower 69 rollers. Chain 62 extends around pivot pulleys or sprockets 61 at either end. Cleats 63 catch the trailing edges of blanks 91 and push them through section 60, causing the raised outer edges 92 to be formed into the end panel corners of the final container. By the time the partially formed container exits section 60, the end panel corners 92 are well defined as shown in FIG. 7C. In particular, the angled plows 71 fold panel 94 against panel 92 along score line 97. Adhesive previously applied between these panels holds them together. Corner 96 is folded into corner 98 so that panel 95 comes into contact with end panel 101. Adhesive previously applied to panel 101 also holds them together. Compression rollers 68 and 69 squeeze panels 95 against end panel 101. Partial openings 90 fit over larger opening 100 on panel 101 defining handles on either end of the container (see FIG. 7C).

Figure 5A:
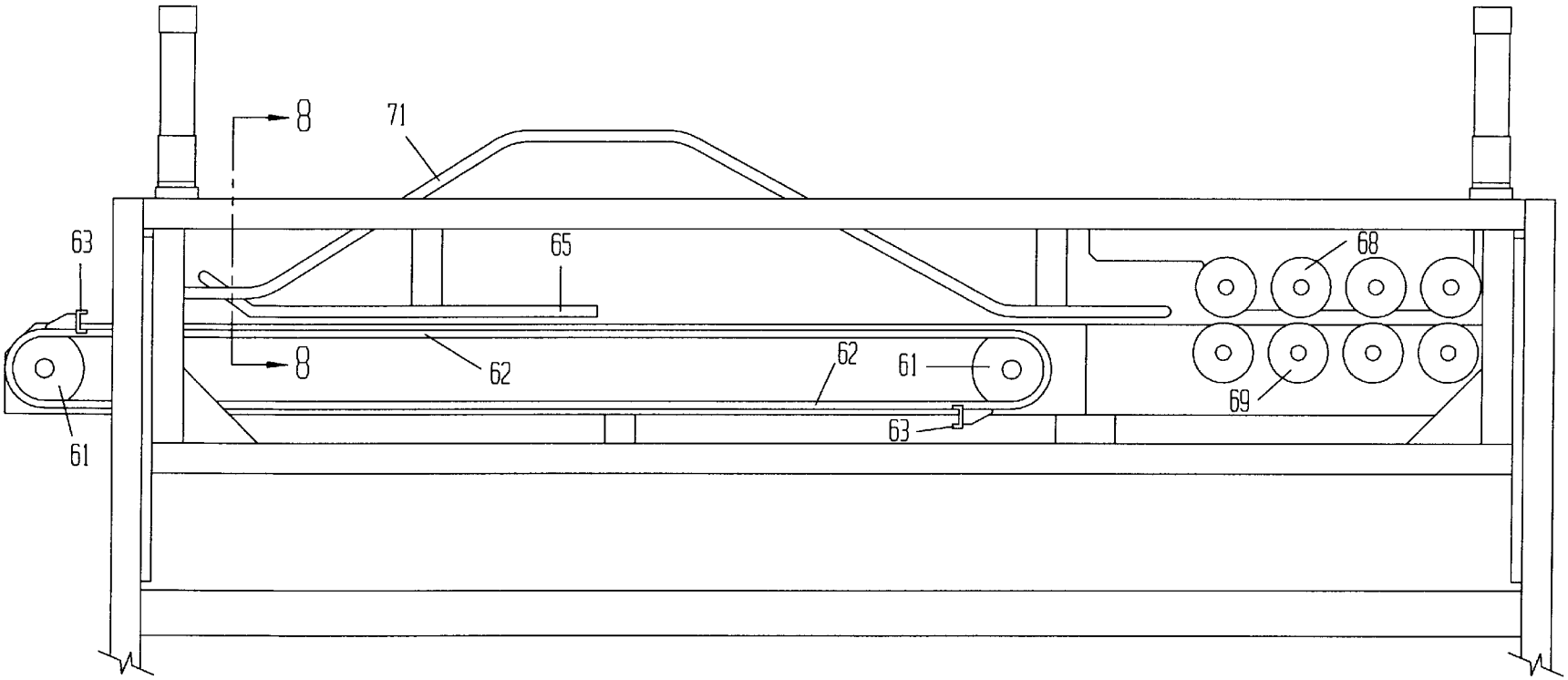
FIG. 5A is an enlarged side view of the pre-forming center section of the machine showing the flighted chain assembly in the raised, operating position.
Figure 5B:
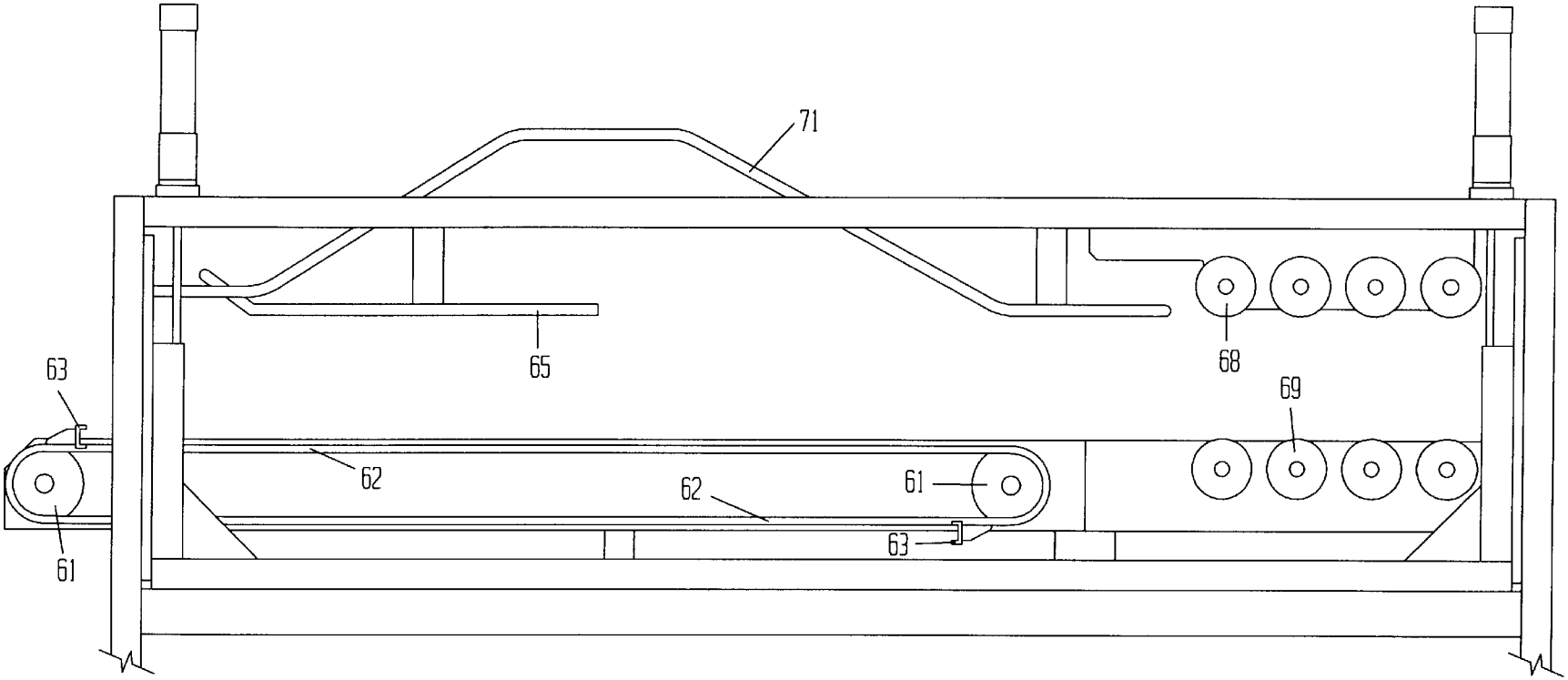
FIG. 5B is an enlarged side view of the center section of the machine showing the flighted chain assembly in the lowered position for service access.

The flight chain assembly 61–63 can be lowered as shown in FIG. 5B thereby separating this motion-imparting assembly from the plows and guides above it. Simultaneously, lower compression rollers 69 can be separated from upper rollers 68. This lowering adjustment can only be accomplished when the machine is not operating, and allows service access to the interior of section 60 of the machine in the event a blank is misfed or becomes jammed in the machine. It is usually very easy to remove such a blank without cutting or tearing it out, or disassembling the machine. The assembly 61–63 may then be again raised to the upper operational position, and operation of the machine can continue.

Figure 6A:
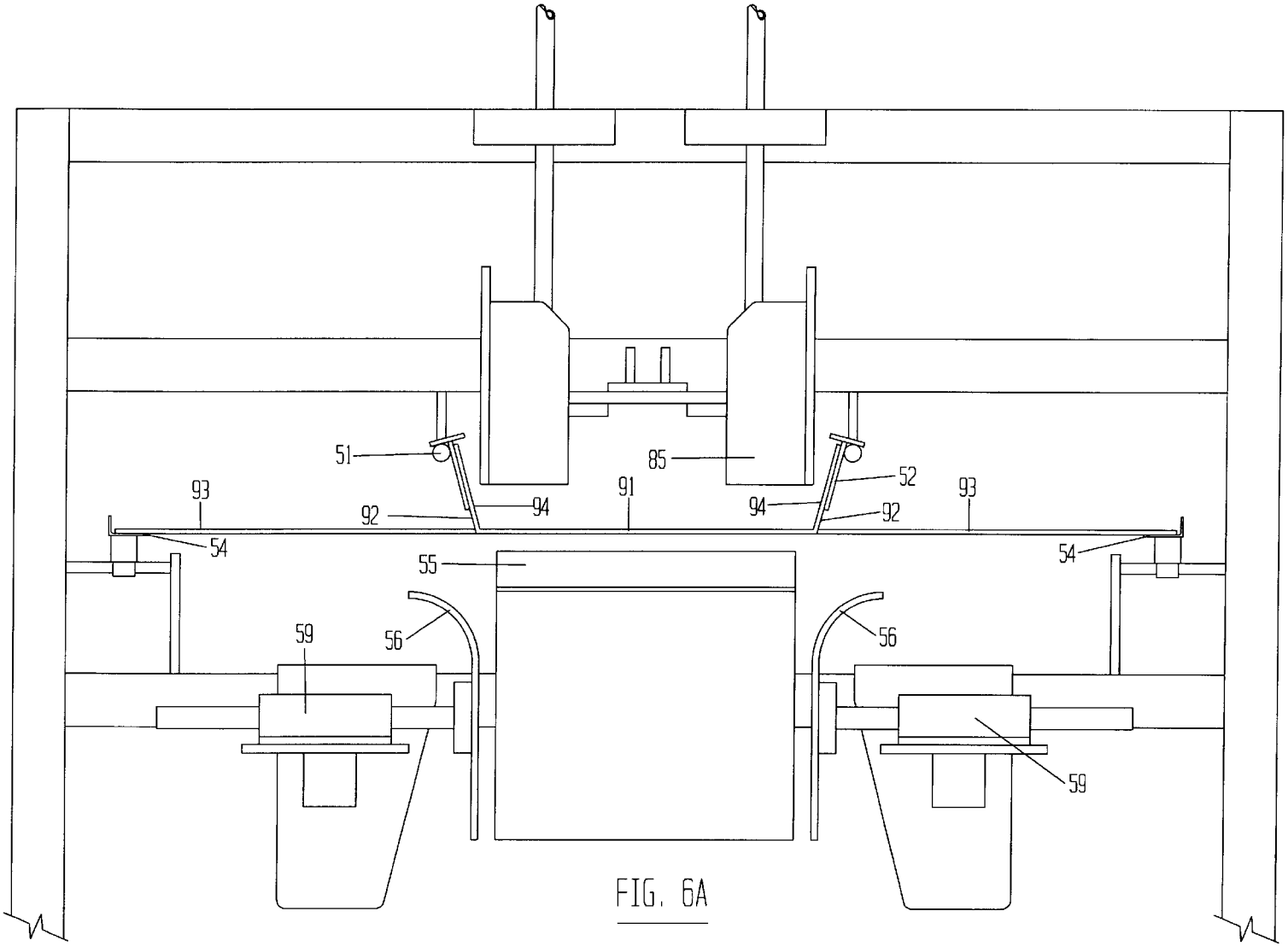
FIG. 6A is an opposite end view along line 6—6 of FIG. 1 showing the mandrel of the machine in the retracted position.

The partially-formed blank 91 is moved from the flap-forming section 60 into the final forming section 80 of the machine by air cylinders (not shown). Section 80 includes a vertically oriented mandrel 85 and a series of final forming plows 52, 55 and 56. Blank 91 has the appearance shown in FIG. 7C as it is moved under mandrel 85 as shown in FIG. 6A. A unique pair of angled flanges 52 supported by rods 51 hold corner panels 92 in an almost vertical position as blank 91 moves under mandrel 85 (see FIGS. 1 and 6A). Side panels 93 are still horizontal at this point, supported at either end by brackets 54. As mandrel 85 is cycled downward, it comes into contact with the middle of blank 91. Mandrel 85 can be of a fixed size for continuous use in forming the same sized containers, or it may be of an adjustable type the size and dimensions of which may be changed to form different container sizes. In either case, mandrel 85 should extend to the four corners of the rectangular midsection 91 of the blank which will eventually become the bottom of the container.

Figure 6B:
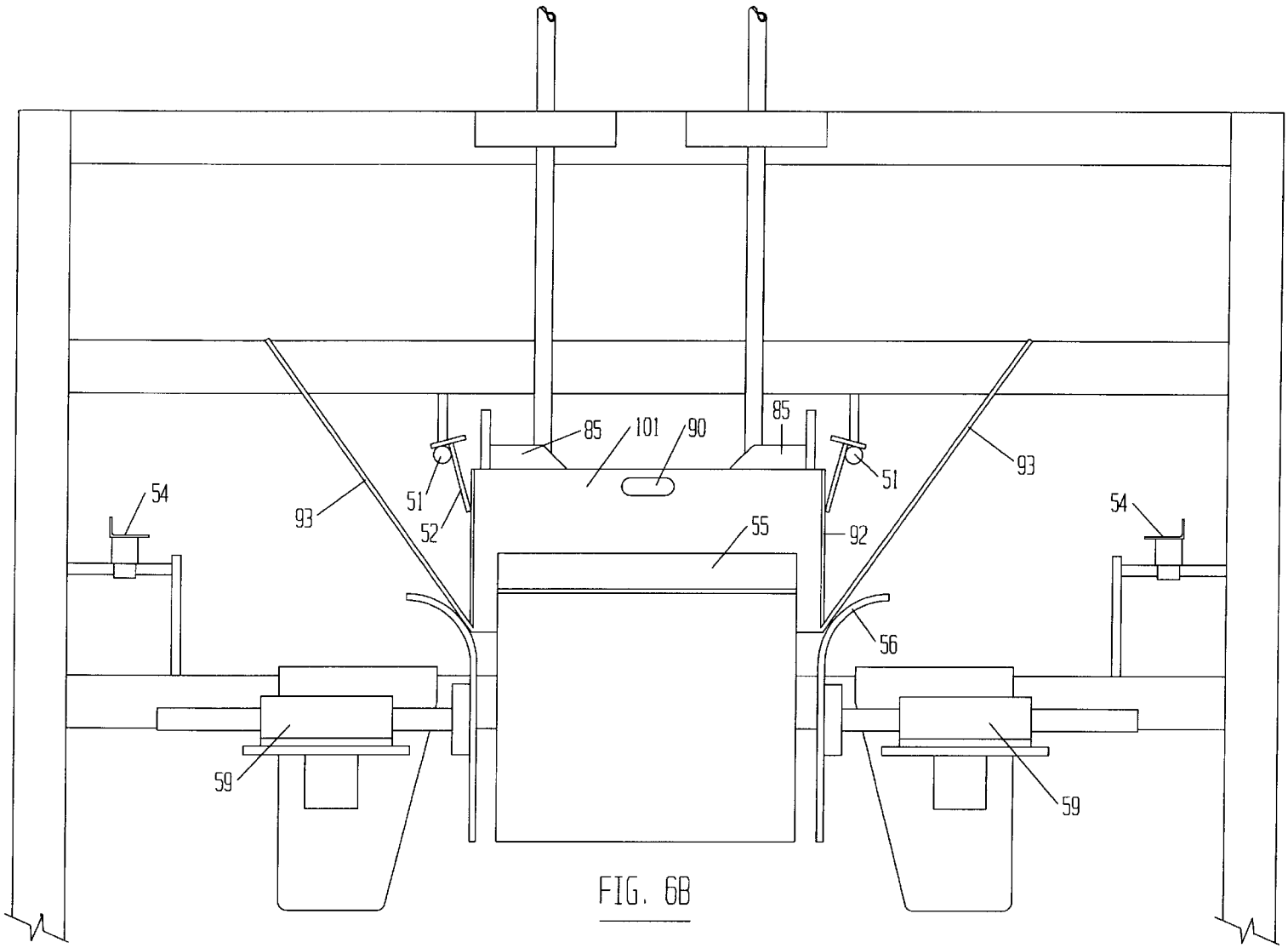
FIG. 6B is an opposite end view along line 6—6 of FIG. 1 showing the mandrel in a partially extended position.

As mandrel 85 moves down, the contact with the bottoms of flanges 52 first force corner panels 92 into a vertical position, as shown in FIG. 7D. Then, contact with plows 55 stands the end panels 101 up in a vertical position, as shown in FIGS. 6B and 7E. Panels 92 now form corners with panels 101 along score line 98. The continued downward motion then causes side panels 93 to make contact with plows 56, standing these side panels up in a vertical position. This activity is underway in FIGS. 6B and 7E. Adhesive previously applied to panels 93 adheres them to corner panels 92, resulting in formation of the container shown in FIG. 7F. The mandrel 85 then retracts, leaving the newly-formed container wedged between plows 56. There is a momentary pause as the next container blank comes into position under mandrel 85 during which the glue has an opportunity to adhere and dry against the several surfaces of the wedged container. Then, before the mandrel cycles to form the next blank, plows 56 are pulled away from the container by the action of air cylinders 59. This release allows gravity to drop the newly-formed container down onto a roller conveyor 89 for removal, loading and sealing. Promptly thereafter, cylinders 59 push plows 56 back into position for forming the next container. The lid of the container is formed using flaps 105 which may be sealed by applying adhesive to side flaps 106 and adhering them to end panels 101.

DESCRIPTION OF THE PREFERRED EMBODIMENTS

In the preferred embodiment, loading bay 10 is capable of receiving a stack or pallet of container blanks at least forty eight inches (48") tall, but this height may be adjusted according to specific application requirements. The side walls 21 should include adjustable arms 41 for different sized container blanks. Eight suction cups are preferred in the loading bay, four interior suction cups 30 and four exterior suction cups 31. The interior suction cups hold the middle of the container blank 91 down while the exterior cups 30 pull the end flaps up. At least four gates are preferred, one at each corner of the loading bay and adjustable with the position of arms 41, in order to hold the four flaps 92 of the container blank in position. Gate flaps 25 should have the same angle as flanges 19 and 44, and should form a continuous flat surface over which end panels 92 may slide from the loading bay 10 to the flap-forming section 60.

In the flap-forming section 60, plow 65 should hold the middle of the container blank in a flat and horizontal position as it passes through. Angled plows 71 will first bend flaps 92, 94 and 95 on the leading edge of the container blank, and will then fold the same flaps in the same way on the trailing edge. Glue or other adhesive should be applied just as the container blank enters the flap-forming section 60 of the machine, before the folding occurs. Flight chain should include adjustable cleats 63 whose position may be changed according to the size of the container blanks to be used. Similarly, plows 71 and 65 should be horizontally and vertically adjustable for different sizes of blanks.

Mandrel 85 may be of a fixed size and removable for replacement with another fixed sized mandrel; or it may be adjustable so that a single mandrel may be used for the formation of different sized container blanks. Flanges 52 should not be vertical, but should be angled at between five and fifteen degrees to allow space for the pre-folded end panels 92 of the container to pass under the mandrel 85 before it cycles down. There should be a close fit between the bottom of flanges 52 and the edges of mandrel 85 so as to straighten up the end panels 92 of the container as the mandrel cycles down. Support brackets 54 should be horizontally adjustable for different sized container blanks. Similarly, flanges 52 and plows 55 and 56 should be laterally adjustable for receipt of container blanks having different lengths and widths.

In use, the dimensions and style of the container to be formed must first be selected. Then, the machine must be adjusted for receiving the appropriately pre-cut and pre-scored container blanks 91. This requires selecting and installing the proper mandrel, and then properly adjusting all of the following, among other things: (1) the side wall squaring arms 41 of the loading bay, (2) the suction volume, (3) the adhesive applicators, (4) the positioning and placement of the pre-forming plows 71 and 65; (5) the positioning and placement of the rollers 68 and 69; (6) the height, width and length of the mandrel 85; (7) the positioning and placement of the final forming flanges and plows 51, 52, 55 and 56; (8) the sprayers and controls for application of adhesive; and (9) the length of advancement on the mandrel stroke. Many other adjustments are also made for proper operation of the machine.

The preferred embodiment of the machine receives a stack 14 of the selected container blanks 91 in the loading bay 10. Lift 11 raises the stack 14 until the uppermost blank 91 is in the working position at flange 39, reachable by the suction cups 30 and 31. Lift 11 stops and the squaring arms 41 of the bay move to center the stack of blanks. Then, the suction cups pull the top blank 91 from the stack. The lift then elevates the remaining blanks in the stack 14 so that the next most upper blank is brought to flange 39, ready for removal, and so on. Meanwhile, outer suction cups 31 pull the leading and trailing end flaps 92 (which include as yet un-folded flaps 94, 95 and 100) apart and away from the center of blank 91 along pre-cut lines 111. Gates 20 are then activated to maintain the separation of flaps 92 from the center of the blank 91. The upper gate support flanges 25 rotate up and under all four flaps 92, forming a continuous rail with flanges 19 and 44 so that flaps 92 may slide into the compression section 60 of the machine in their raised position.

The suction is removed, and overhead transfer 17 pushes the blank 91 under adhesive applicators (not shown) which apply adhesive material to flaps 92, 94, 101 as well as 93 for later adhesion. A flighted chain assembly 62 forming a continuous band underneath blank 91 includes lugs 63 which engage the trailing end of the blank. Rotation of the chain and lugs moves the blank forward, pushing it against a series of angled plows 71 which fold and bend the raised flaps 92.

In particular, the flaps 92 of the leading edge are first folded along score line 98. Then flap 94 is folded along score line 97 against flap 92. Adhesive has been applied between these flaps. At about the same time, flap 95 is folded along score line 96 such that flap 95 comes into contact with end panel 101. Adhesive has also been applied to panel 101. Openings 90 in flaps 95 are placed to correspond to opening 100 in panel 101. This pre-folded portion of the container blank 91 is then moved through compression rollers 68 and 69 which firmly press together the adhesive between the flaps. The same plows cause the same folding of the end flaps 92 at the trailing edge of the container blank.

The pre-folded blank is then conveyed underneath the mandrel 85 which moves downward to engage the middle 91 of the blank. As the mandrel cycles downward, a first pair of parallel plows 51 below the mandrel bend the end panels 101 up to a vertical position; then, a second pair of parallel plows 52 mounted perpendicular to the first pair of plows bend the side panels 93 up to a vertical position. Adhesive previously applied to corner panels 92 sticks to side panels 93 forming the main box of the container. The mandrel 85 cycles fully downward, pressing the corners together and straightening the side and end panels of the newly-formed container. Mandrel 85 retracts, then plows 56 release the container which then falls out of the machine as a result of gravitational force.

Adjustable automated electronic controls should be provided for controlling the timing, speed and overall operation of the lift, squaring arms, gates, conveyors, suction, air cylinders, flight chain, rollers, mandrel, plows and other machine parts, as well as the timing and quantity of adhesive applied to the container blanks.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

We claim:

1. A machine for forming a fiberboard container comprising:

a. a vertical loading bay for receiving a stack of precut and pre-scored flat fiberboard container blanks, said bay comprising an open end and two parallel side walls, a lift, squaring arms for positioning said blanks, two pluralities of overhead suctions for removing the uppermost blank from the stack the first such plurality being centrally located for reaching the midsection of the uppermost container blank, and the second such plurality having locations near the four corners of the bay in order to reach the corners of the container blank, said second plurality being capable of upwardly raising the pre-cut end flaps at the corners of said container blank higher than the midsection thereof, a plurality of separation gates and angled support rails in the side walls of said bay for elevating the pre-cut end flaps on the leading and trailing edges of said blank from the midsection thereof, and an overhead feed for conveying said blank, leading edge first, into the flap former of the machine;

b. a flap former for pre-folding the leading and trailing edges of said container blank, said former comprising a plurality of applicators for spraying adhesive onto portions of said blank, a plurality of angled forming plows and rods for forming end panels from the elevated pre-scored end flaps on the leading and trailing edges of said container blank, a horizontal conveyor with cleats for moving said blank through said plows, a plurality of compression rollers for securing the folded adhesively sprayed flaps of said blank, and a conveyor for moving said blank into a final container former; and c. a final container former comprising a second pair of angled rails for supporting the corners of said end panels as said blank is received from said flap former, an adjustable mandrel having a vertical stroke, a first set of adjustable parallel forming plows below said mandrel along the path of said stroke for forming the ends of the container to be formed, a second set of adjustable parallel forming plows along the path of said stroke below said first set and perpendicular thereto for forming the sides of said container, and a conveyor below said second set of plows for removing the formed container from the machine.

2. The machine described in claim 1 wherein said horizontal conveyor and said compression rollers in said flap former can be lowered when the machine is not operating to allow service access to the interior of the machine in the event of a jam or misfeed.

3. The machine described in claim 1 wherein a pair of separation gates is provided on each of the opposite side walls of said loading bay in the vicinity of the four corners of the loading bay, the gates of each such pair being separated by an angled rail between them on the inside of such side wall so that after the uppermost container blank is removed from the stack, activation of the gates provides support to the upwardly raised end flaps thereof, which support is maintained by said rails as said blank is moved horizontally out of the bay.

4. The machine described in claim 3 wherein each of said gates is comprised of a pivotally mounted plate attached to an air cylinder, such plate being movable between a position that is flush with the adjacent side wall to a position that is flush with the adjacent angled rail.

5. The machine described in claim 4 wherein said applicators spray adhesive material onto selected locations of said upwardly raised end flaps and onto other locations of the midsection of said blank.

6. The machine described in claim 5 wherein said angled forming plows and rods receive the upwardly raised end flaps of said blank and cause said flaps to be folded overlappingly inward along pre-scored lines to partially form the end panels of said blank.

7. The machine described in claim 6 wherein said second pair of angled rails is provided below said retractable mandrel for holding the partially-formed end panels in angled relation to said mandrel until the down stroke of said mandrel forces said panels between said rails and into a vertical orientation.

8. The machine described in claim 6 wherein said second set of parallel forming plows are retractable such that after said mandrel has retracted after forcing said container blank between such plows, said plows retract releasing said formed container blank to fall out of the machine.

9. In a machine for forming a fiberboard container, a pre-forming apparatus comprising:

a. a vertical loading bay for receiving a stack of precut and pre-scored flat fiberboard container blanks, said bay comprising an open end and two parallel side walls, a lift, squaring arms for positioning said blanks, two pluralities of overhead suctions for removing the uppermost blank from the stack, the first such plurality being centrally located for reaching the midsection of the uppermost container blank, and the second such plurality having locations near the four corners of the bay in order to reach the corners of the container blank, said second plurality being capable of upwardly raising the pre-cut end flaps at the corners of said container blank higher than the midsection thereof; a plurality of separation gates and angled support rails in the side walls of said bay for elevating the pre-cut end flaps on the leading and trailing edges of said blank from the midsection thereof, and an overhead feed for conveying said blank, leading edge first, into the flap former of the machine; and b. a flap former for pre-folding the leading and trailing edges of said container blank, said former comprising a plurality of applicators for spraying adhesive onto portions of said blank, a plurality of angled forming plows and rods for forming end panels from the elevated pre-scored end flaps on the leading and trailing edges of said container blank, a horizontal conveyor with cleats for moving said blank through said plows, a plurality of compression rollers for securing the folded adhesively sprayed flaps of said blank, and a conveyor for moving said blank into a final container former.

10. The machine described in claim 9 wherein said horizontal conveyor and said compression rollers in said flap former can be lowered when the machine is not operating to allow service access to the interior of the machine in the event of a jam or misfeed.

11. The machine described in claim 9 wherein a pair of separation gates is provided on each of the opposite side walls of said loading bay in the vicinity of the four corners of the loading bay, the gates of each such pair being separated by an angled rail between them on the inside of such side wall so that after the uppermost container blank is removed from the stack, activation of the gates provides support to the upwardly raised end flaps thereof, which support is maintained by said rails as said blank is moved horizontally out of the bay.

12. The machine described in claim 11 wherein each of said gates is comprised of a pivotally mounted plate attached to an air cylinder, such plate being movable between a position that is flush with the adjacent side wall to a position that is flush with the adjacent angled rail.

13. The machine described in claim 12 wherein said applicators spray adhesive material onto selected locations of said upwardly raised end flaps and onto other locations of the midsection of said blank.

14. The machine described in claim 13 wherein said angled forming plows and rods receive the upwardly raised end flaps of said blank and cause said flaps to be folded overlappingly inward along pre-scored lines to partially form the end panels of said blank.

15. A method for forming a fiberboard container comprising the steps of:

a. placing a stack of pre-cut and pre-scored container blanks into a vertical loading bay, b. activating a lift mechanism in the loading bay to raise the stack of blanks, c. centering the position of the blanks in said bay, d. applying suction to remove the uppermost blank from the stack, said suction raising the corner flaps of said blank higher than the midsection thereof, e. activating separating gates located in the side walls of the bay to maintain the raised separation of said corner flaps, f. conveying the blank out of the bay along a set of angled rails to maintaining the raised, separation of the corner flaps, g. applying adhesive to selected sections of the blank, h. pushing the blank through a plurality of folding plows which overlappingly fold the raised corner flaps into partial end panels, i. compressing the folded panels together to firm up the adhesive between them, j. moving the folded blank under a vertically oriented mandrel, k. activating the mandrel in a down stroke pushing the blank through a first pair of parallel end panel forming plows, l. continuing to push the blank downward through a second perpendicular set of side panel forming plows, m. retracting the mandrel, and n. retracting the plows to release the container.

* * * * *